US009086237B2

(12) United States Patent
Konkle

(10) Patent No.: US 9,086,237 B2
(45) Date of Patent: Jul. 21, 2015

(54) VACUUM DRYING OF HEAT EXCHANGER TUBES

(71) Applicant: Carrier Corporation, Farmington, CT (US)

(72) Inventor: Eric Konkle, Plainfield, IN (US)

(73) Assignee: CARRIER CORPORATION, Farmington, CT (US)

( * ) Notice: Subject to any disclaimer, the term of this patent is extended or adjusted under 35 U.S.C. 154(b) by 219 days.

(21) Appl. No.: 13/761,224

(22) Filed: Feb. 7, 2013

(65) Prior Publication Data

US 2013/0205614 A1 Aug. 15, 2013

Related U.S. Application Data

(60) Provisional application No. 61/596,812, filed on Feb. 9, 2012.

(51) Int. Cl.

| | |
|---|---|
| ***F26B 5/04*** | (2006.01) |
| ***F26B 25/00*** | (2006.01) |
| *F26B 3/30* | (2006.01) |

(52) U.S. Cl.

CPC ..... *F26B 5/04* (2013.01); *F26B 25/006* (2013.01); *F26B 3/30* (2013.01)

(58) Field of Classification Search

CPC ..... F26B 3/00; F26B 5/00; F26B 5/04; F26B 7/00; B08B 9/00; B08B 9/02; B08B 3/00; B08B 3/04; B01D 1/16; B01D 1/22; B01D 1/26; B01D 5/009; F24F 3/00; F24F 3/16

USPC ..... 34/380, 381, 407, 413, 497, 77, 78, 80, 34/90; 165/178; 29/890.047, 890.036; 134/18, 108, 169 C; 62/430, 502, 515; 159/13.1, 48.2, 49

See application file for complete search history.

(56) References Cited

U.S. PATENT DOCUMENTS

| | | | | |
|---|---|---|---|---|
| 3,238,633 | A | 3/1966 | Hackenberg | |
| 3,763,572 | A * | 10/1973 | Titus | 34/58 |
| 3,800,845 | A | 4/1974 | Scoggin | |
| 4,053,990 | A | 10/1977 | Bielinski | |
| 4,581,133 | A | 4/1986 | Tomes | |
| 5,045,117 | A | 9/1991 | Witherell | |

(Continued)

FOREIGN PATENT DOCUMENTS

| | | | |
|---|---|---|---|
| CA | 2150753 | C | 6/1995 |
| WO | WO2004081440 | A1 | 9/2004 |
| WO | WO2010088127 | A2 | 8/2010 |

*Primary Examiner* — Steve M Gravini
(74) *Attorney, Agent, or Firm* — Cantor Colburn LLP

(57) ABSTRACT

A method and an apparatus are disclosed for removing a solvent from a solvent wetted surface of a heat exchange tube. The method includes placing the heat exchange tube in a vacuum chamber, evacuating the vacuum chamber to a lower pressure at which the solvent boils to a vapor, and reclaiming the solvent vapor. The method may include heating the heat exchange tube within the vacuum chamber to a temperature of at least room temperature, but below the solvent's flash point temperature. The apparatus includes a vacuum chamber, a vacuum pump for evacuating the vacuum chamber and a solvent reclaimer for recovering solvent vapor. The apparatus may also include an infrared heater, a radiant heater or other non-flame heater. The method and apparatus may be used for removing solvent from a heat exchange tube having an inside surface wetted with a solvent carrying a dry lubricant.

13 Claims, 2 Drawing Sheets

(56) References Cited

U.S. PATENT DOCUMENTS

| | | | | |
|---|---|---|---|---|
| 5,232,476 | A | 8/1993 | Grant | |
| 5,346,534 | A * | 9/1994 | Grant | 95/39 |
| 5,715,612 | A * | 2/1998 | Schwenkler | 34/470 |
| 5,749,159 | A * | 5/1998 | Schwenkler | 34/426 |
| 5,820,748 | A | 10/1998 | Shadikhan | |
| 6,829,844 | B2 * | 12/2004 | Brady et al. | 34/381 |
| 7,147,944 | B2 | 12/2006 | Tei et al. | |
| 7,753,060 | B2 | 7/2010 | Kozy et al. | |
| 2005/0009998 | A1 | 1/2005 | Rath et al. | |
| 2006/0169302 | A1 | 8/2006 | Kozy et al. | |
| 2006/0185691 | A1 | 8/2006 | Joseph | |
| 2013/0205614 | A1 * | 8/2013 | Konkle | 34/407 |
| 2013/0313822 | A1 * | 11/2013 | Jones et al. | 285/289.5 |

* cited by examiner

VACUUM DRYING OF HEAT EXCHANGER TUBES

CROSS-REFERENCE TO RELATED APPLICATIONS

This application claims the benefit of U.S. provisional patent application Ser. No. 61/596,812 filed Feb. 9, 2012, the entire contents of which are incorporated herein by reference.

BACKGROUND OF THE INVENTION

Exemplary embodiments pertain generally to manufacture of heat exchanger tubes and, more particularly, to the removal of residual solvent from a prelubricant applied to heat exchanger tubes during the manufacturing process.

Tube coil heat exchangers are commonly used in many industrial applications wherein it is desired to transfer heat from one fluid to another fluid, one fluid passing through the heat exchange tubes and the other fluid passing over the heat exchange tubes. For example, evaporators, condensers, and other heat exchanger of various heating, ventilating and air conditioning and refrigeration (HVAC&R) equipment are conventionally tube coil heat exchangers. Typically, a plurality of fins are mounted to the heat exchange tubes forming the tube coil heat exchanger.

In manufacturing such tube coil heat exchangers, the heat exchange tubes are passed through holes punched in the fin sheet. Each hole is surrounded by a collar of sheet material formed when the holes for receiving the tubes are punched in the fin sheet. To ensure intimate contact between the fins and the exterior surface of the heat exchange tubes, it is customary, after the fins have been assembled onto the heat exchange tubes to force a mandrel through each heat exchange tube. The mandrel is sized to cause the heat exchange tube to expand radially outward thereby establishing intimate contact between the exterior surface of tube and the fin collars circumscribing the tubes.

When manufacturing finned tube coil heat exchangers with aluminum or aluminum alloy tubes, it is conventional practice to lubricate the interior of the tubes prior to forcing the mandrel through the tube. Proper lubrication of the inside of the tube is necessary due to the high coefficient of friction characteristic of aluminum and aluminum alloy tubes. One method of prelubricating the tubes is to apply a dry lubricant carried in a liquid solvent, typically a volatile organic compound, to the inside surface of the tube. After the lubricant has been applied, it is necessary to remove the solvent, thereby leaving a residual wax-like film coating the inside surface of the tubes.

The conventional practice for removing the liquid solvent from the inside surface of the tube, is to blow dry air through the tube while heating the lubricated tube to a temperature above the boiling point of the solvent for a sufficient period of time to ensure that all the solvent has been evaporated and the solvent vapors carried away by the air passing through the tube. It is important that all the solvent be removed as the presence of solvent is detrimental to the performance of the lubricant in facilitating the subsequent passage of the mandrel through the tube during the tube expansion process. Thus, care must be taken to ensure complete evaporation of the solvent. Further, such volatile organic compounds are flammable and the temperature to which the tube must be heated is generally above the flash point of the solvent. Therefore, care must be taken to properly exhaust the solvent vapors away and avoid reaching the flammable limits. Conventionally, the solvent vapors are simply exhausted to the atmosphere or incinerated.

SUMMARY OF THE INVENTION

In one aspect, a process is provided for safely removing solvent from a solvent wetted surface of a heat exchange tube without heating the tube to a temperature in excess of the flashpoint of the solvent vapor.

In one aspect, a process is provided for recovering solvent removed from the solvent wetted tubes.

In an aspect, a process is provided for removing solvent by vacuum drying from a heat exchange tube having an inside surface wetted with a solvent carrying a dry lubricant.

A method for removing a solvent from a solvent wetted surface of a heat exchange tube includes: placing the prelubricated heat exchange tube in a vacuum chamber, evacuating the vacuum chamber to a lower pressure at which the solvent boils to a solvent vapor, and reclaiming the solvent vapor. The method may further includes heating the heat exchange tubes within the vacuum chamber sufficiently to maintain a temperature of the heat exchange tubes at a temperature between at least room temperature, but below a flash point temperature of the solvent. The method may also include recycling the reclaimed solvent. In an aspect, the method may be applied to removing a solvent from a heat exchange tube having an inside surface wetted with a solvent containing a dry lubricant, thereby leaving a dry lubricant coating on the inside surface of the heat exchange tube.

In an embodiment of the method, evacuating the vacuum chamber to a lower pressure at which the solvent boils to a solvent vapor includes evacuating the vacuum chamber to a lower pressure at which the solvent boils to a solvent vapor at room temperature. In an embodiment, reclaiming the solvent vapor includes venting the solvent vapor from the vacuum chamber, condensing the vented solvent vapor to a liquid solvent, and collecting the liquid solvent. Condensing the vented solvent vapor to a liquid solvent may include contacting the solvent vapor with a refrigerated condensing surface.

An apparatus for carrying out a process for removing a solvent from a prelubricated heat exchange tube includes a vacuum chamber configured to house the prelubricated heat exchanger tubes during the process, a vacuum pump operable to evacuate the vacuum chamber, a flow duct connecting the vacuum pump in flow communication with the vacuum chamber, and a solvent reclaimer disposed in the flow duct downstream of the vacuum chamber. The solvent reclaimer may include a refrigerated condensing surface for condensing the solvent vapor to a liquid and a reclaimed solvent tank may be provided in operative association with the solvent reclaimer for receiving the condensed solvent. The apparatus may also include a non-flame producing heater disposed in operative association with the vacuum chamber, such as an infrared heater or a radiant heater.

BRIEF DESCRIPTION OF THE DRAWINGS

For a further understanding of the disclosure, reference will be made to the following detailed description which is to be read in connection with the accompanying drawing, wherein.

DETAILED DESCRIPTION OF THE INVENTION

Figure 1:
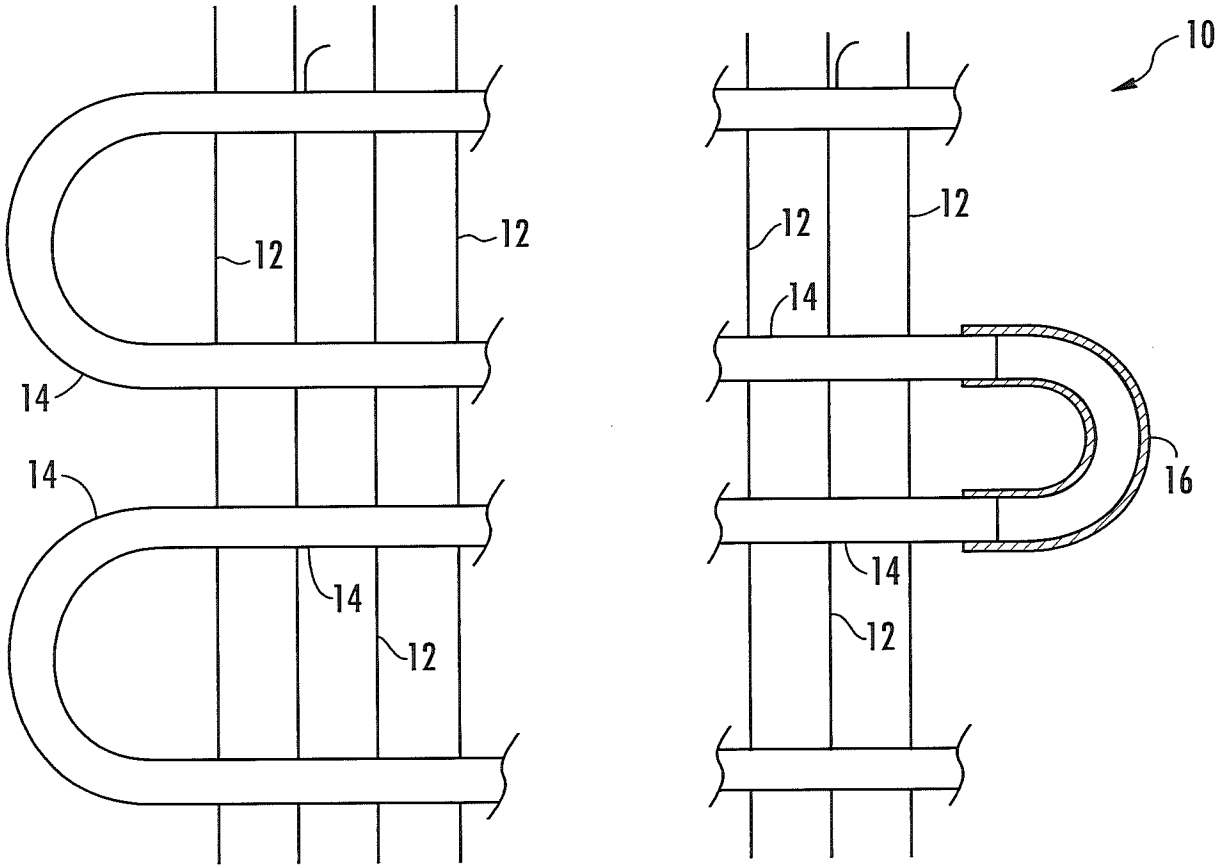
FIG. 1 is a side elevation view, partly in cross-section, of an exemplary embodiment of a finned tube bank having hairpin heat exchanger tubes.

Referring initially to FIG. 1, there is depicted an exemplary embodiment of a finned tube coil heat exchanger 10 including a plurality of fins 12 and a plurality of heat exchange tubes 14 extending through the plurality of fins 12. The heat exchange tubes 12 are generally disposed in an array of spaced rows and spaced columns. Each heat exchange tube 14 defines an interior fluid flow passage. In the embodiment of the finned tube coil heat exchanger depicted in FIG. 1, the tube coil is formed of a plurality of hairpin tubes interconnected by generally U-shaped return bends 16 to form one or more fluid flow circuits through the tube coil.

Each fin 12 of the plurality of fins comprises a relatively thin metal sheet having a plurality of holes punched therein in a pattern matching the tube array. The fins 12 are assembled in spaced relationship on the plurality of heat exchange tubes 14 with the heat exchange tubes 14 received in and passing through the holes of a plurality of fins 12. Each heat exchange tube 14 defines an interior fluid flow passage through which a first fluid passes in heat exchange relationship with a second fluid passing over the exterior surface of the heat exchange tubes 14 and along the surface of the fins 12.

To ensure good heat transfer contact between the fins 12 and the heat exchange tubes 14, it is customary practice to expand the tubes radially outward after the fins 12 have been assembled on the heat exchange tubes 14. To expand the heat exchange tubes 14 radially outward, an oversized mandrel (not shown) is forced through the interior flow passage of the tube, thereby causing the tube wall to expand radially outward such that the exterior surface of the tube is pressed into intimate contact with the fin collars (not shown) that are formed around each of the holes formed in the fins 12 during the fin hole punching operation.

When manufacturing finned tube coil heat exchangers with aluminum or aluminum alloy tubes, it is necessary to lubricate the interior passage of the heat exchange tubes 14 prior to forcing the oversized mandrel through the tube. Proper lubrication of the inside of the tube is necessary due to the high coefficient of friction characteristic of aluminum and aluminum alloy tubes. One method of prelubricating the tubes is to apply a dry lubricant carried in a liquid solvent, typically a volatile organic compound, to the inside surface of the tube, for example, by passing a flow of the lubricant carried in the liquid solvent through the interior flow passage of the tube 14 to thoroughly wet the inside surface of the tube. The prelubricant mixture may, for example, consist essentially of one part dry lubricant and 9 parts volatile organic compound (VOC) solvent. After the lubricant has been applied and the solvent drained from the tubes, it is necessary to "dry" the wetted tubes to remove residual solvent from the inside surface of the tubes 14, thereby leaving a residual wax-like film coating the inside surface of the tubes.

Figure 2:
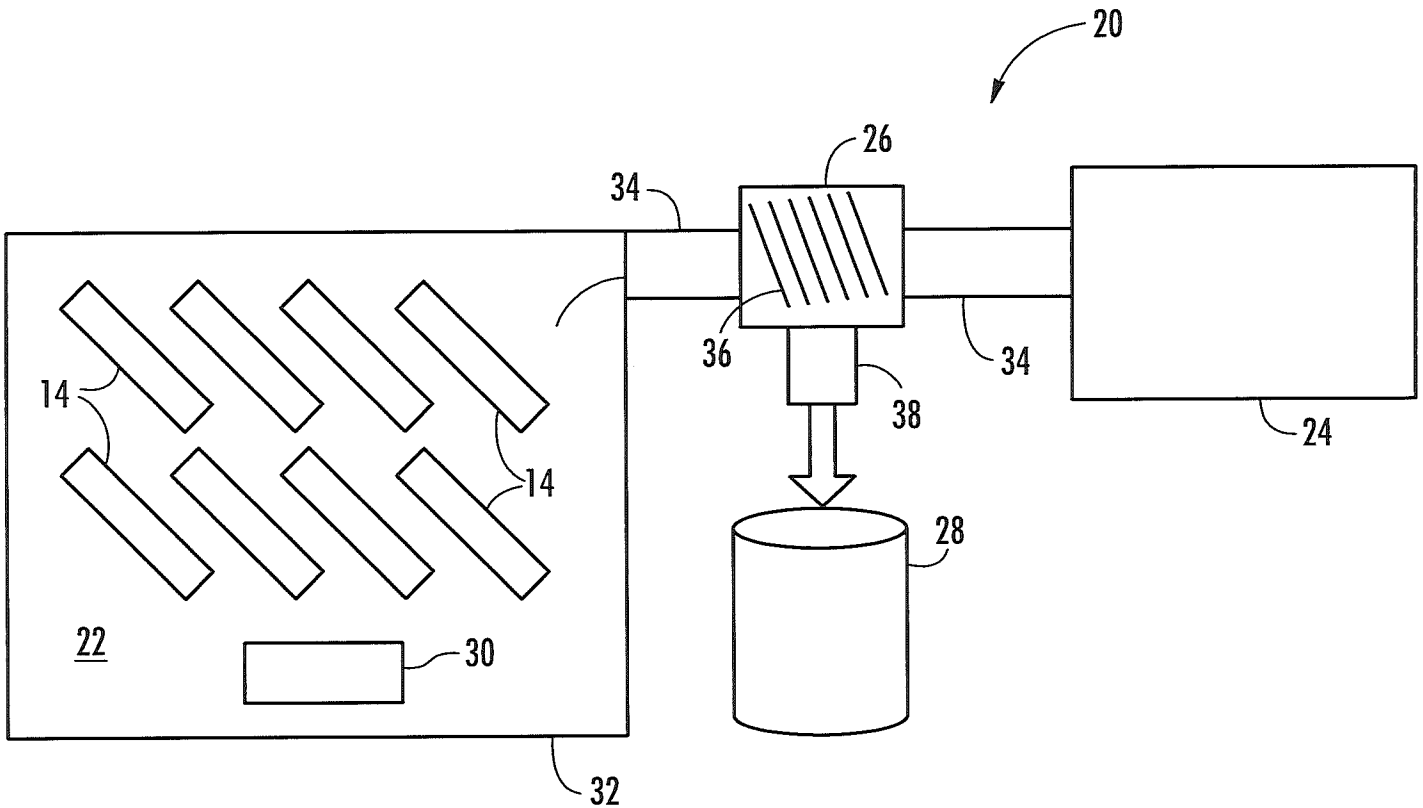
FIG. 2 is a schematic diagram depicting an embodiment of an apparatus for vacuum drying of solvent-wetted heat exchanger tubes with solvent reclaiming.

Referring now to FIG. 2, there is depicted an embodiment of an apparatus, generally designated 20, for vacuum drying of solvent-wetted heat exchange tubes 14 with solvent reclaiming in accordance with the method disclosed herein. The apparatus 20 includes a vacuum chamber 22, a vacuum pump 24 selectively operable to evacuate the vacuum chamber 22, a solvent reclaimer 26, and a reclaimed solvent tank 28. The apparatus 20 may also include an optional heater 30 operatively associated with the vacuum chamber 22.

The vacuum chamber 22 sized to receive and to house during the solvent removal process a plurality of heat exchange tubes, such as hairpin heat exchange tubes 14, that have been previously wetted with a dry lubricant carried in a solvent and require drying to remove residual solvent. After the heat exchange tubes 14 have been loaded into the vacuum chamber 22, the access door (not shown) to the vacuum chamber enclosure 32 is closed to provide an air-tight vacuum chamber 22. The vacuum pump 24 is operatively connected in flow communication with the vacuum chamber 22 by a flow duct 34, which provides the only flow communication with the vacuum chamber 22. In the embodiment of the apparatus 20 depicted in FIG. 2, a heater 30 is disposed in operative association with the vacuum chamber 22. The heater 30 may be an infrared heater, a radiant heater, or other form of non-flame producing heater. A heater having a flame is not suitable due to the flammable nature of the volatile solvent. The non-flame producing heater 30 may be disposed within the vacuum chamber 22.

The solvent reclaimer 26 is disposed in the flow duct 34 downstream of the vacuum chamber 22 and upstream of the vacuum pump 24. It is to be understood that downstream and upstream are relative to the direction of flow through the flow duct 32 from the vacuum chamber 22 to the vacuum pump 24 during operation of the apparatus 20. The solvent reclaimer 26 includes at least one solvent capture device 36, and generally a plurality of solvent capture devices 36, disposed in the flow path of the flow passing through the flow duct 34. The solvent capture devices 36 may comprise refrigerated condensation surfaces, for example cooled tubes or plates, cooled membrane filters or other devices capable of causing solvent vapors to condense. The condensed solvent drains from the solvent reclaimer 26 through drain pipe 38 into the reclaimed solvent tank 28 wherein the solvent is stored for recycling.

After the wetted lubricated heat exchange tubes 14 are loaded into the vacuum chamber 22 and the vacuum chamber 22 is sealed, the vacuum pump 24 is started to evacuate the vacuum chamber 22. As the pressure decreases inside the vacuum chamber, the boiling point of the solvent is reduced. The vacuum pump 24 draws a vacuum within the vacuum chamber 22 down to a level at which the solvent will boil. Once the vacuum reaches a low enough pressure, the solvent will begin to boil at room temperature. For example, if the vacuum chamber 22 is at room temperature, the vacuum pump 24 will draw a vacuum with the vacuum chamber 22 of 0.012 millibars to boil the solvent thereby facilitating evaporation of the solvent.

As noted earlier, a heater 30 may be provided in operative association with the vacuum chamber 22. The heater 30 may be activated to heat the vacuum chamber 22 and the heat exchange tubes 14 therein to counteract the natural cooling effect produced by evaporation of the solvent and maintain room temperature. The heater 30 may also be activated to heat the vacuum chamber 22 to a temperature above room temperature, but below the flash point of the particular solvent being removed. For example, the heater could be activated to heat the vacuum chamber to a temperature of about 40° C. (104° F.) to speed the solvent evaporation process. Heating the heat exchange tubes 14 within the vacuum chamber also counteracts the natural cooling effect produced by evaporation of the solvent.

The solvent vapors formed upon boiling of the solvent at the low pressure established within the vacuum chamber 22 by the vacuum pump 24 are drawn out of the vacuum chamber 22 into the flow duct 34, which is during operation the only opening into the sealed enclosure 32. In passing through the flow duct 34, the solvent vapors enter the solvent reclaimer 26 wherein the solvent vapors contact the solvent capture devices 36, such as refrigerated condensation surfaces. Upon contacting the refrigerated condensation surfaces 36, the solvent vapors cool and condense back into liquid phase. The condensed solvent drains from the solvent reclaimer 26 through drain pipe 38 to be captured in the reclaimed solvent tank 28. Once all the solvent has been evaporated from the heat exchange tubes 14 and reclaimed, the vacuum is released from the vacuum chamber 2, the sealed enclosure 32 opened, and the dry heat exchange tubes 14 removed from the vacuum chamber 22. The inside surface of the heat exchange tubes 14 removed from the vacuum chamber 22 is now coated with wax-like coating of dry lubricant.

The apparatus and method for removing a solvent by vacuum drying from heat exchange tubes having an inside surface wetted with a solvent carrying a dry lubricant so as to leave a dry lubricant coating on the inside surface of the heat exchange tubes as disclosed herein provides a safe process for removing residue solvent from the solvent wetted surface(s) of the heat exchange tubes while avoid the risks associated with flammable solvent liquids and vapors in a heated environment. With the apparatus and method disclosed herein, the solvent is recovered and reclaimed for re-use; thereby reducing the emission of VOCs into the environment and providing for recycle of the solvents. Additionally, the vacuum drying method disclosed herein may reduce the variableness of lubricity within the heat exchange tubes.

Although the apparatus and method disclosed have been described herein with reference to removing solvent by vacuum drying from heat exchange tubes having an inside surface wetted with a solvent carrying a dry lubricant, it is to be understood that the method and apparatus disclosed may have other applications. For example, it is contemplated that the vacuum drying process with solvent recovery disclosed herein, and the apparatus for carrying out the process, could also be used for removing residual solvent from any surface of the heat exchanges wetted with a solvent during other operations, such as from the outside surface of heat exchange tubes wetted with a cleaning solvent.

The terminology used herein is for the purpose of description, not limitation. Specific structural and functional details disclosed herein are not to be interpreted as limiting, but merely as basis for teaching one skilled in the art to employ the present invention. Those skilled in the art will also recognize the equivalents that may be substituted for elements described with reference to the exemplary embodiments disclosed herein without departing from the scope of the present invention.

While the present invention has been particularly shown and described with reference to the exemplary embodiments as illustrated in the drawing, it will be recognized by those skilled in the art that various modifications may be made without departing from the spirit and scope of the invention. Therefore, it is intended that the present disclosure not be limited to the particular embodiment(s) disclosed as, but that the disclosure will include all embodiments falling within the scope of the appended claims.

I claim:

1. A method for removing a solvent from a solvent wetted surface of a heat exchange tube, comprising:

placing the solvent wetted heat exchange tube in a vacuum chamber;

evacuating the vacuum chamber to a lower pressure at which the solvent boils to a solvent vapor; and reclaiming the solvent vapor;

wherein placing the heat exchange tube in a vacuum chamber comprises placing a heat exchange tube having an inside surface wetted with a prelubricant including a solvent carrying a lubricant.

2. The method as set forth in claim 1 wherein reclaiming the solvent vapor comprises:

venting the solvent vapor from the vacuum chamber;

condensing the vented solvent vapor to a liquid solvent; and collecting the liquid solvent.

3. The method as set forth in claim 2 wherein condensing the vented solvent vapor to a liquid solvent comprises contacting the solvent vapor with a refrigerated condensing surface.

4. The method as set forth in claim 1 wherein evacuating the vacuum chamber to a lower pressure at which the solvent boils to a solvent vapor comprises evacuating the vacuum chamber to a lower pressure at which the solvent boils to a solvent vapor at room temperature.

5. The method as set forth in claim 1 further comprising heating the heat exchange tube within the vacuum chamber with a non-flame producing heater.

6. The method as set forth in claim 5 further comprising heating the heat exchange tube within the vacuum chamber sufficiently to maintain a temperature of the heat exchange tube at room temperature.

7. The method as set forth in claim 5 further comprising heating the heat exchange tube within the vacuum chamber sufficiently to maintain a temperature of the heat exchange tube at a temperature above room temperature and below a flash point temperature of the solvent.

8. The method as set forth in claim 5 wherein heating the heat exchange tube within the vacuum chamber sufficiently to maintain a temperature of the heat exchange tube at a temperature of about 40° C. (104° F.).

9. The method as set forth in claim 1 further comprising recycling the reclaimed solvent.

10. A method for removing a solvent from a heat exchange tube having an inside surface, comprising:

wetting an inside surface of the heat exchange tube with a prelubricant including a solvent carrying a lubricant;

placing the solvent wetted heat exchange tube in a vacuum chamber;

evacuating the vacuum chamber to a lower pressure at which the solvent boils to a solvent vapor, thereby leaving a dry lubricant coating on the inside surface of the heat exchange tube; and reclaiming the solvent vapor.

11. The method as set forth in claim 10 wherein reclaiming the solvent vapor comprises:

venting the solvent vapor from the vacuum chamber;

condensing the vented solvent vapor to a liquid solvent; and collecting the liquid solvent.

12. The method as set forth in claim 10 wherein evacuating the vacuum chamber to a lower pressure at which the solvent boils to a solvent vapor comprises evacuating the vacuum chamber to a lower pressure at which the solvent boils to a solvent vapor at room temperature.

13. The as set forth in claim 10 further comprising heating the heat exchange tube within the vacuum chamber sufficiently to maintain a temperature of the heat exchange tube at a temperature of at least room temperature and below a flash point temperature of the solvent.

* * * * *